United States Patent [19]

Fowler et al.

[11] Patent Number: 4,990,061

[45] Date of Patent: Feb. 5, 1991

[54] FLUID CONTROLLED GAS LIFT PUMP

[76] Inventors: Elton D. Fowler; Eileen C. Fowler, both of 202 Pasadena Dr., Victoria, Tex. 77904

[21] Appl. No.: 349,433

[22] Filed: May 9, 1989

Related U.S. Application Data

[63] Continuation-in-part of Ser. No. 122,362, Nov. 3, 1987, abandoned, which is a continuation-in-part of Ser. No. 921,532, Oct. 22, 1986, abandoned.

[51] Int. Cl.[5] ..... F04F 1/06

[52] U.S. Cl. ..... 417/143; 417/137

[58] Field of Search ..... 417/137, 143

[56] References Cited

U.S. PATENT DOCUMENTS

| | | | |
|---|---|---|---|
| 1,744,002 | 1/1930 | Price | 417/137 |
| 1,890,720 | 12/1932 | Chenault . | |
| 2,265,099 | 12/1941 | Chenault | 417/141 |
| 2,313,066 | 3/1943 | Hatfield | 417/137 |
| 2,318,029 | 5/1943 | Thompson et al. | 417/137 X |
| 3,647,319 | 3/1972 | McLean et al. | 417/144 X |
| 3,894,814 | 7/1975 | Morgan | 417/128 X |
| 3,905,724 | 9/1975 | Strebel | 417/128 |
| 4,625,807 | 12/1986 | Harlow | 417/143 X |

*Primary Examiner*—Leonard E. Smith
*Assistant Examiner*—Eugene L. Szczecina, Jr.
*Attorney, Agent, or Firm*—G. Turner Moller

[57] ABSTRACT

A well pumping system uses a closed gas cycle to periodically unload a pumping chamber in a well. The system includes a tubing string having a downhole pumping chamber providing a check valve at the lower end. A packing assembly defines the upper end of the pumping chamber and includes a dip tube having a check valve allowing upward liquid movement through the dip tube. A conduit passes through the packing assembly. Pressurized gas is periodically pumped down the conduit to force liquid upwardly through the dip tube and tubing string. Cycling of the pressurized gas is controlled by a liquid seal control assembly at the surface. When the pumping chamber has been unloaded, the gas therein flows up the conduit and through the seal control assembly to a suction tank. The pressurized gas is thus maintained in a closed cycle.

16 Claims, 3 Drawing Sheets

FLUID CONTROLLED GAS LIFT PUMP

This application is a continuation-in-part of copending application Ser. No. 07/122,362, filed Nov. 3, 1987, now abandoned, which was a continuation-in-part of application Ser. No. 06/921,532, filed Oct. 22, 1986, now abandoned.

Historically, irrigation has not been extensively utilized in coastal regions or regions of moderate rain fall when droughts are sometimes serious but only of one or two months duration. The application of irrigation by use of a submerged pump has become cost prohibitive in many cases due to increased investment, maintenance, and operating costs. This invention was developed for the purpose of providing a system using minimum power and maintenance for pumping water from shallow wells or reservoirs.

The pump involves several working elements which are described as follows:

I. A power driven compressor is located at a convenient location to the well or reservoir to be pumped. The power driver to the compressor can be from gas, electricity, or a wind powered system. Due to the relatively low horsepower delivered to the system and due to consistent performance over a range of loads it is fully intended that most applications will incorporate a wind power unit. The function of the compressor is to compress gas from a suction bottle to supply the compressed gas for moving the fluid.

II. The second part of the pumping unit is the pumping cylinder or tank. The pumping cylinder incorporates two check valves and an internal tube in the cylinder that are assembled in such a fashion that when submerged in a reservoir that the cylinder is filled on depressurization of the cylinder and emptied through the internal tube to an elevated location when the cylinder is adequately pressurized.

III. The third major part of the pumping unit is the fluid seal control unit. In this unit a sealing fluid, almost always water, is alternately pressurized to an upper chamber and after allowing the cylinder to depressurize, allowed to flow into a flower chamber in order to control the pressurization and depressurization of the pumping cylinder. The fluid seal control unit controls the pressurization of the pumping cylinder and the depressurization of the pumping cylinder to the suction bottle.

The principal of pressurization of a chamber or cylinder to pump a fluid has been proposed by others as shown in U.S. Pat. Nos. 1,744,002 and 2,471,498. It is believed that the control of such units, in particular for service at very large depths, has been difficult.

It is an object of this invention to provide an improved well pumping system.

A further object of this invention is to provide a simple, inexpensive well pumping system requiring very little maintenance.

Other objects and advantages of this invention will become more fully apparent as this description continues, reference being made to the accompanying drawings and appended claims.

IN THE DRAWINGS

DETAILED DESCRIPTION OF THE INVENTION

Figure 1:
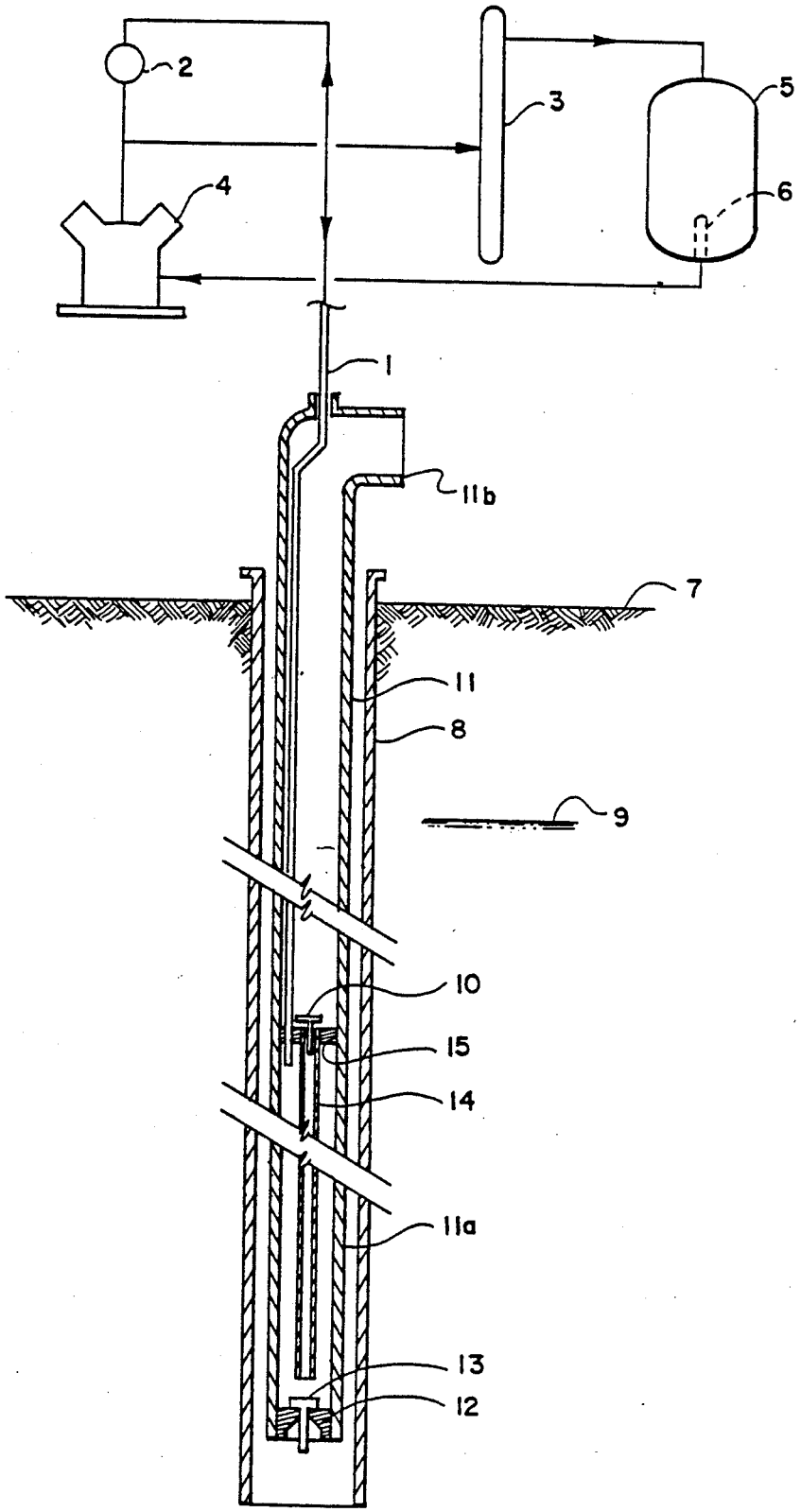
FIG. 1 is a schematic view of the well pumping system of this invention.

The construction of a typical pumping cylinder is shown schematically in FIG. 1. A tubing string 11 is inserted in a fixed well casing 8 extending into the earth below ground level 7 and includes a pump cylinder 11*a* on the lower end thereof. Installations for pumping from a reservoir would utilize a cylinder with a larger diameter and relatively short length.

An upper check valve 10 and packing assembly - valve seat 15 is installed near the top of the cylinder 11*a* at a point safely below the level of water in the reservoir 9. The inlet to the upper check valve 10 is connected to a smaller center or dip tube 14 which extends downward to near the bottom of the pumping cylinder 11*a*. A lower fill check valve 13 and valve seat 12 is installed at the bottom of the pumping cylinder 11*a*. The inlet to the fill check valve 13 is from the well casing and the outlet is to the pumping cylinder 11.

A gas tube 1 is connected to the pumping cylinder 11*a* through the packing assembly - valve seat 15. Compressed gas is supplied to the cylinder 11*a* through the gas tubing 1 and gas is also vented from the pumping cylinder 11*a* through the gas supply tube or tubing 1.

The functions of the pumping cylinder 11*a* are as follows. When atmospheric pressure is supplied to the cylinder through the gas tubing 1, water enters through the lower check valve 13 and fills the cylinder and also rises through the upper check valve 10 to equalize to the level of the reservoir 9. The water level is also equalized in the gas tubing 1. If an initial gas pressure is supplied to the suction tank 5 that is equivalent to the liquid head above the upper check valve 10, the level of water in the supply tube 1 is displaced to the cylinder 11*a*. This pressure is established in the suction bottle 5. When the compressor 4 is started to supply gas to the cylinder 11*a*, the liquid from the cylinder 11*a* is displaced from the cylinder 11*a* out of the center tube 14 and up the tubing 11 to the tubing outlet or delivery point 11*b*. The gas supply is limited to only displace water from the cylinder 11*a* to a point above the bottom of the center tube 14 as opposed to blowing all the liquid out of the cylinder 11*a* and tubing 11. After water from the cylinder 11*a* is displaced by compressed gas supplied through the gas tube 1, the gas from the cylinder 11*a* is vented through the supply tube 1 to the suction bottle 5. This lowers the pressure in the cylinder 11*a* and water flows from the well casing 8 into the cylinder 11*a* through the lower check valve 13 to refill the pumping cylinder 11*a*. The quantity of water above the upper check valve 10 is maintained during the depressurization and filling of the cylinder 11*a* and also the center tube 14 is maintained full of water since it could only be emptied by leakage of the upper check valve 10. Thus, pumping from the system of this invention results in a series of relatively rapid water pulses emitting from the outlet 11*b*.

Figure 2:
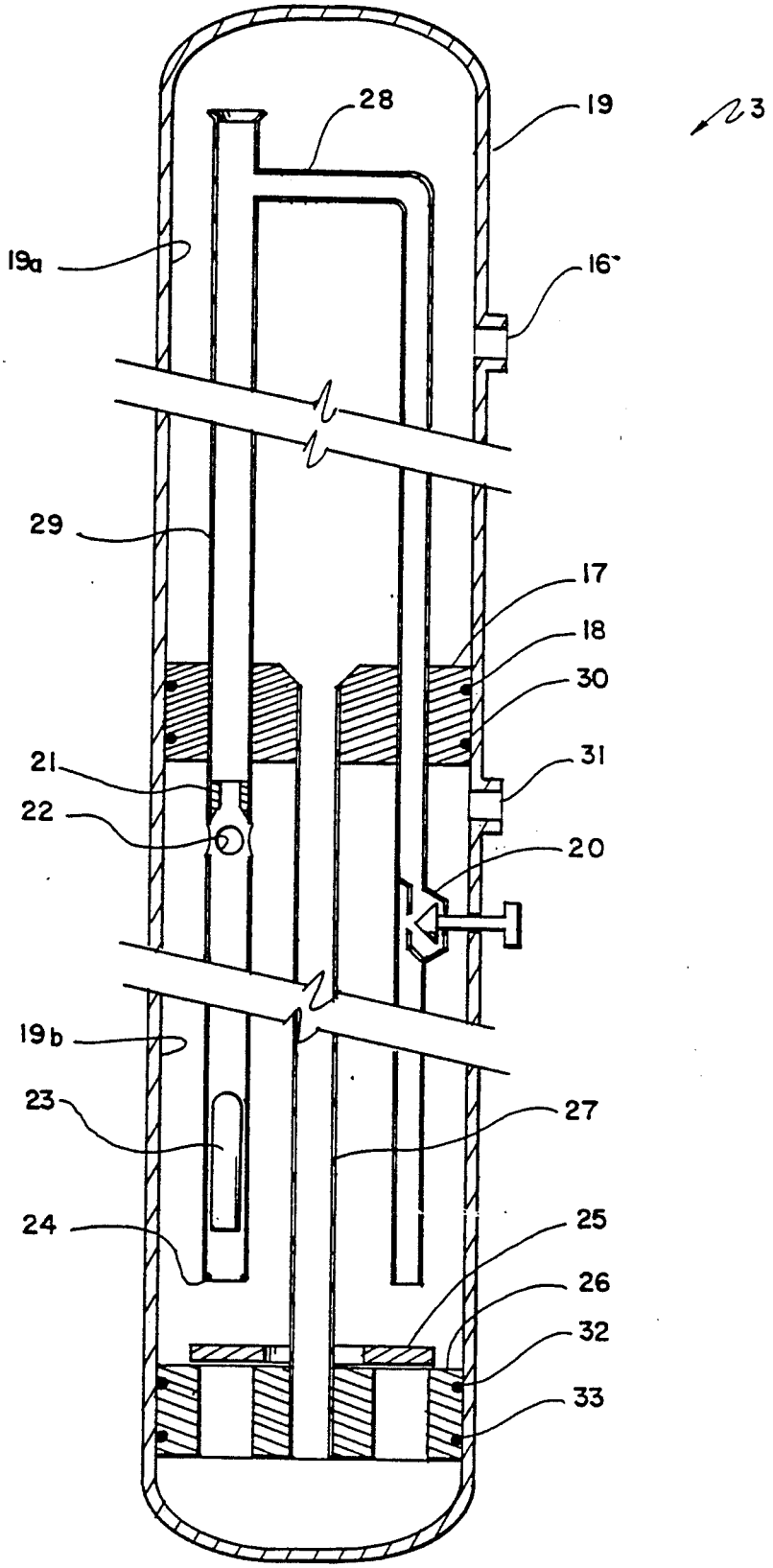
FIG. 2 is an enlarged vertical cross-sectional view of the fluid seal unit of this invention.

The fluid control unit 3 is shown schematically in FIG. 2. The unit comprises a tubular casing 19 which is normally about 100 inches in length and approximately the same diameter as the pumping cylinder 11*a*. The ends of the casing 19 are sealed. The casing 19 is mounted vertically. An internal baffle 17 separates the casing into an upper compartment or chamber 19*a* and a lower compartment or chamber 19*b*. The baffle 17 is fixed in the casing 19 and is sealed by O-rings 18, 30. The upper chamber 19*a* is connected to the suction tank 5 from the outlet connection 16 and thus is always exposed to compressor suction pressure.

The lower chamber 19*b* is connected to the compressor 4 discharge in parallel with pumping chamber 11*a* by the gas tubing 1. The lower chamber 19*b* is always maintained at compressor discharge pressure which is also the supply pressure to or from the vent pressure from the pumping cylinder 11*a*. A fluid flow tube 28 of relatively small diameter, typically one half inch in diameter, the sizing of which is discussed later, passes from the lower section of the bottom chamber 19*b* through the baffle 17 to near the top of the upper chamber 19*a*. A variable flow orifice 20 which is adjustable external to the unit regulates liquid flow in the flow tube 28.

A gas flow tube 29 passes through the baffle 17 from the lower chamber 19*b* to near the top of the upper chamber 19*a*. The fluid flow tube 28 is connected to always discharge into the upper end of the gas flow tube 29. A float valve 23 in the gas flow tube 29 cooperates with a valve seat 21 located just below the baffle 17. The float valve 23 is of hollow construction and is designed to float in water. Ports 22 are drilled in the gas flow tube 29 just below the seat 21 in such a manner that when the float valve 23 drops to the bottom position, gas is free to flow from the lower chamber 19*b* to the upper chamber 19*a* through the gas flow tube 29. Typically, the gas flow tube 29 is one inch in diameter and the seat 21 is 0.55 inches in diameter. When water or sealing fluid is charged to the bottom of the chamber 19*b*, the float valve 23 rises to close any gas flow in the gas flow tube 29 from the bottom chamber 19*b* to the upper chamber 19*a* and is further held closed by any positive differential pressure that might exist from the bottom to the upper chamber.

A liquid flow down tube 27 is connected to allow flow of fluid from the upper chamber 19*a* to the lower chamber 19*b* through a check valve 25 any time the differential pressure from the lower chamber 19*b* to the upper chamber 19*a* is substantially equalized. When the lower chamber pressure is higher than the upper chamber pressure, the check valve 25 seals any flow of gas or liquid to the upper chamber 19*a*. Sealing fluid, which is normally water, is charged to the unit prior to pressurization of the suction tank 5. The sealing fluid level is established to fill the unit several inches above the baffle 17. The float valve 23 rises to the closed position when the sealing fluid is charged and the lower chamber 19*b*, down flow tube 27 and the volume below the check valve 25 are filled with sealing fluid. The level of sealing fluid above the baffle 17 is not critical.

The functions of the cycle control unit are as follows. When the suction bottle 5 is pressurized to an initial pressure, gas flow from the compressor 4 is started and the flow begins to pressurize the lower chamber 19*b* and the pumping cylinder 11*a* simultaneously. As pressure in the lower chamber 19*b* rises, the sealing fluid is displaced through the fluid flow tube 28 and past the orifice 20, first filling the portion of the gas flow tube 29 above the float valve 23 and then to overflow into the upper chamber 19*a*. During this phase of the operation of the control unit 3, liquid flow in the conduit 28 provides a restriction or back pressure to the compressor 4 diverting most of the pressurized gas from the outlet into the gas supply tube 1.

When sufficient sealing fluid is displaced into the upper chamber 19*a*, gas from the lower chamber 19*b* displaces all liquid from the flow tube 28 so there is an essentially unrestricted gas flow path from the compressor outlet, through the control unit 3 and tank 5 to the compressor inlet. This causes the entire output of the compressor to flow through the control unit 3 and allows gas in the gas supply tube 1 to flow upwardly toward the surface so that pressure in the pumping chamber 11*a* falls and water from the reservoir 9 refills the chamber 11*a*.

The gas flow continues through the fluid flow tube 28 until the differential pressure between the chambers 19*a*, 19*b* equalizes to a value equal to the liquid head in the gas flow tube 29 above the float valve 23 plus any differential pressure equivalent to the weight of the float valve 23 which is no longer submerged in sealing fluid. After the float valve 23 drops, pressure rapidly equalizes between the upper and lower chambers 19*a*, 19*b* through the ports 22 and the gas flow tube 29. The float valve 23 remains open to equalize the pressure between the chambers 19*a*, 19*b* until the sealing fluid flows from the upper chamber 19*a* to the lower chamber 19*b* through the down flow tube 27 and the fluid check valve 25 to establish a level sufficient to raise the float valve 23 to the closed position. The elevation of the seat 21 for the float valve 23 substantially affects operation of the control unit 3 and is normally just below the baffle 17.

The level of sealing fluid remaining in the upper chamber 19*a* after re-establishing the liquid seal in the lower chamber 19*b* is not critical. The unit 3 will fill with condensation or oil from the compressor 4 over a period of time until it flows over to the suction bottle 5 during the equalization or venting stage. For this reason the outlet 16 from the upper chamber 19*a* is located 30 to 40 inches above the baffle 17 to provide some liquid head to facilitate the flow of sealing fluids to the lower chamber 19*b* upon equalization of pressure between the chambers 19*a*, 19*b*.

The timing of the pumping cycle is adjusted by adjusting the variable orifice 20. As the variable orifice 20 is opened the fluid flow for a given differential pressure is increased causing the pressurization cycle to be shorter. The orifice 20 is adjusted for the maximum gas flow available to the pumping cylinder 11*a*. In the event the gas flow is decreased from the compressor 4, the flow rate through the variable orifice 20 decreases and the pumping cycle is simply extended as the pumping cylinder 11*a* is also displaced at a slower rate. The vent or equalization portion of the cycle remains the same as at the maximum gas flow except that when the gas flow is sufficiently reduced the quantity of liquid displaced from the cylinder 11*a* is less than maximum for each cycle and correspondingly the quantity of gas to be equalized or vented is less.

The volume of sealing fluid that must flow from the lower chamber 19*b* to the upper chamber 19*a* is fixed by diameter of the casing 19 and the location of the bottom of the fluid flow tube 29 and the location of the baffle 17. The liquid flow through the variable orifice 20 is initially low and partially restricted by the liquid head above the orifice 20. As the pressure differential increases the liquid flow increases and is estimated by the following equation:

$$Q = 236d^2C\sqrt{\Delta P/\rho}$$

where

Q=rate of liquid flow, GPM

C=orifice coefficient, constant of orifice 20=0.62 for Reynolds numbers higher than 10,000 and ratio of orifice to pipe diameter of 0.5

$\rho$=water density, 62.4 lbs/ft$^3$ $\Delta$P=differential pressure across orifice, psi d=diameter of flow tube 28, inches After the fluid flow tube 28 is blown clear of sealing fluid, the gas flow is calculated by:

$$W = 1891d^2YC\sqrt{\Delta P\rho}$$

where

W=gas flow rate, lbs/hour d=orifice diameter, inches

C=orifice coefficient=0.62 for Reynolds numbers greater than 10,000 and a ratio of orifice to pipe diameter of 0.5

$\rho$=air density, lbs/ft$^3$

Y=coefficient of expansion, a function of the ratio of differential to absolute pressure These flow characteristics result in a much higher volumetric flow rate for the gas than for the sealing fluid which allows a rapid depressurization of the lower chamber 19*b* and pumping cylinder 11*a*. An example of calculations of the final liquid and initial gas flow is presented as follows:

TABLE I

| | |
|---|---|
| Length of fluid flow tube | 100 inches |
| Variable orifice opening | 0.25 inches diameter |
| Diameter of fluid flow tube | 0.5 inches |
| Differential pressure across compressor at end of pressurization | 600 inches $H_2O$ |
| Compressor discharge pressure | 56 psia |
| Final liquid flow rate | 5.0 gpm (0.67 ACFM) |
| Initial gas flow rate | 26.0 ACFM |

The final liquid flow rate occurs just as the liquid flow tube 28 begins to be blown free of liquid and the initial gas flow rate occurs just after the liquid flow tube 28 is emptied of sealing fluid.

For the example calculated, the volumetric gas flow rate is higher by a factor of 38. Therefore, the variable orifice 20 can be sufficiently open to allow a rapid initial depressurization of the lower chamber 19*b* and the pumping cylinder 11*a*. It is noted that the final differential pressure available for transfer of the liquid is less than that for the gas by the liquid head contained in the fluid flow tube 28.

The conditions of opening the float valve 23 are described as follows. The liquid head above the variable orifice 20 in the fluid flow tube 28 is always equal to or greater than the liquid head above the float valve 23 until the fluid seal tube 28 is blown empty of sealing fluid. Because the fluid flow tube liquid head is established only by differential pressure between the chambers 19*a*, 19*b*, the pressure below the float valve 23 is always greater than the liquid head above the float valve 23 until the fluid is blown from the fluid flow tube 28. As long as there is a positive flow of fluid through the fluid flow tube 28, there must also be positive differential pressure to maintain the float valve 23 closed until after the fluid flow tube 28 is blown empty of liquid and sufficient liquid head exists above the float valve 23 to overcome the positive differential pressure from the bottom chamber 19*b* to the upper chamber 19*a*.

In the event that the gas flow is stopped during a pressurization cycle, the sealing fluid is free to drain from the fluid flow tube 28 to the lower chamber 19*b*. The differential pressure between the chambers 19*a*, 19*b* then equalizes, the lower chamber 19*b* refills through the down flow tube 27 and the condition of the unit 3 is exactly as described for the initiation of the pressurization stage. The compressor 4 and gas flow can be restarted at any time. There is no point of interruption of the gas cycle that it cannot be promptly restarted simply by initiation of the gas flow to reestablish the normal cycles.

The initial pressure rises rapidly from the compressor 4 after the venting stage as gas does not enter the pumping cylinder 11*a* until the differential pressure required to open the upper check valve 10 against the liquid head to the delivery point 11*b* is established. The volume of gas tubing 1 to be pressurized is normally less than 1% of the pumping cylinder 11*a*. Therefore, the system would not pump with gas flows below 1% of the maximum as the fluid seal would simply be circulated before the gas tubing 1 would be sufficiently pressurized to begin displacing the pumping cylinder 11*a*.

Sealing fluid flow in the cycle flow unit 3 is as follows. The level of liquid charged to the unit is sufficient to fill the unit above the baffle 17. It should not be necessarily charged to the point of overflow to the suction tank, but if this were to occur, it would not present a problem since any excess could be displaced to the suction bottle 5 during the vent stage of the pumping cycle. A fixed quantity of sealing fluid is transferred to the upper chamber through the fluid flow tube 28 from the bottom chamber 19*b* on each cycle. The same fixed quantity is returned to the bottom chamber 19*b* through the downflow tube 27 and the fluid check valve 25 each time the pressure between the chambers 19*a*, 19*b* is equalized. The quantity is controlled since the float valve 23 does not reseat to stop the equalization until the fluid level rises above the float valve 23. Some condensation and some lubricating oil enters the fluid flow unit 3 from the compressor 4. This material, a very small amount, accumulates in the fluid control unit 3 to the point that the excess will flow from the outlet 16 into the suction bottle 5. The oil from the compressor, being lighter than water, tends to separate in the upper chamber but the sealing fluid may become milky in color from oil contamination which has no bad effect and only serves to lubricate the two valves in the unit, i.e. float valve 23 and fluid check valve 25. Any significant accumulation of oil in the cycle control unit 3 is prevented as it is preferentially separated to the top and removed to the suction bottle 5 during the equalization cycle.

Figure 3:
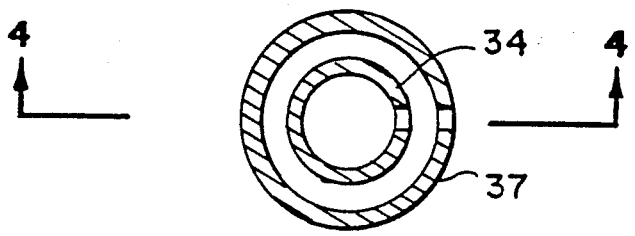
FIG. 3 is an enlarged vertical cross-sectional view of the mechanism in the bottom of the suction tank.
Figure 4:
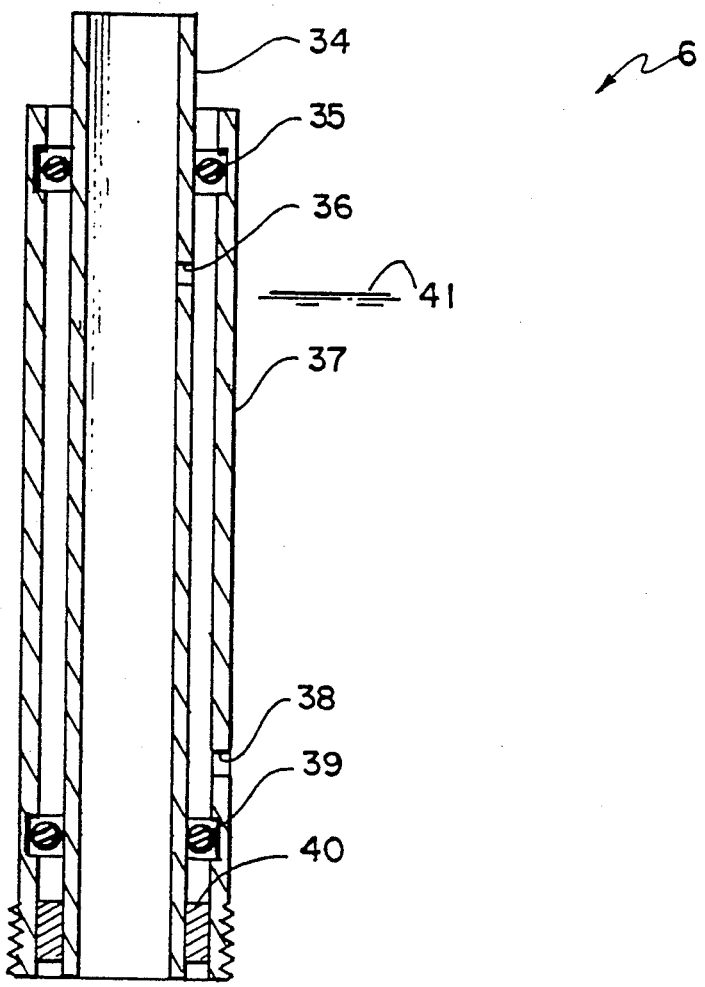

The oil flow to the compressor is controlled by the oil flow tube 6. The oil flow tube 6 is shown in FIG. 3. The oil flow tube consists of two concentric tubes 34, 37 sized such that a slight annulus exists between the tubes and the annulus is sealed at each end by O-rings 39, 35 and by packing 40. The oil flow tube 6 is installed in the suction bottle 5 in such a fashion that flow can occur from the suction tank through the center tube 34 or from the lower oil inlet hole 38 in the outer tube, through the annulus, through the oil outlet hole 36 in the inner tube to the compressor 4. Oil is initially charged to the suction bottle 5 to overflow out the outlet hole 36 and thus a seal is formed such that only oil can flow through the inlet hole 38 and outlet hole 36. The inlet hole 38 is placed a few inches above the bottom of the suction bottle 5 in order that any water accumulated can be periodically drained from the bottle 5 through a separate drain. A slight accumulation of water results from any condensation of water vapor from the gas vented from the pumping cylinder 11. The oil level 41 is indicated on FIG. 3.

The purpose of the dual metering holes and the liquid seal is to prevent the compressor 4 from filling with oil during periods that it is shutdown and no oil flow is required. The oil flow is generated by the differential pressure in the center tube when the compressor 4 is in normal service.

The total cycle of oil flow is from the suction bottle 5 to the compressor through lower hole 38, annulus and upper hole 36 in the oil flow tube 6. Any oil flow to the pumping cylinder 11 is prevented by the small separator 2 which drains back to the fluid cycle control unit 3 during the equalization venting stage. In the fluid cycle control unit 3, the oil separates from the water in the upper chamber from which it overflows to the suction bottle 5. Thus the oil cycle is totally enclosed between suction bottle 5, the compressor 4 and the fluid cycle control unit 3. The inventory of oil in the suction tank is several gallons and the addition of fresh oil is normally required on less than an annual basis even in continuous service. The quantity of oil circulated is designed to be adequate for maximum lubrication since total circulation results in no loss from the cycle much like a standard refrigeration system.

The power required to be delivered to the gas from the suction bottle 5 conditions to generate the pressure required to displace the cylinder varies with cylinder depth. As an example of the difference in power and its comparison to the power required simply to lift the water the following example is presented:

EXAMPLE

Distances indicated are from a reference point which is the delivery point at ground elevation.

| | |
|---|---|
| Distance to water level | 30 feet |
| Distance to top of cylinder | 40 feet |
| Distance to bottom pumping point | 70 feet |
| Suction bottle pressure | 4.2 psig |
| Suction bottle temperature | 60° F. |

Objective—Calculate the power required to compress the air from suction condition to the pressure required to displace the cylinder versus cylinder length.

Estimated Power to Deliver 100 gpm of Water Verses Cylinder Depth

| Depth From Top of Cylinder, Ft | Air* Pressure PSIA | Pounds Air 100 gal. Water | Horsepower for 100 gpm Calculated | Horsepower for 100 gpm Theoretical |
|---|---|---|---|---|
| 0 | 31.53 | 2.31 | 1.09 | 0.758 |
| 10 | 35.73 | 2.64 | 1.30 | 1.011 |
| 20 | 39.93 | 3.01 | 1.98 | 1.263 |
| 30 | 44.13 | 3.38 | 2.63 | 1.768 |

*Air pressure to the pumping cylinder.

Horsepower is calculated for isothermal compression. Seven to ten percent power reduction is calculated if the expansion were isoentropic. The theoretical horsepower is the power actually delivered to the water being pumped. Contribution of the suction tank in reducing the power for pumping averages 12.4% for the four depths. This is calculated as the difference in enthalpy of air at the suction tank conditions from atmospheric pressure divided by the total enthalpy difference of air between the suction tank conditions and the pressure required to displace the cylinder at that depth.

It is pointed out that the estimated numbers are calculated for isothermal compression. In the event that heat loss is eliminated from the supply tubing and the compression were adiabatic the reduction in horsepower for each cylinder depth could be reduced by the following amounts:

| Depth from Top of Cylinder | % Power Reduction |
|---|---|
| 0 | 6.7 |
| 10 | 7.7 |
| 20 | 9.6 |
| 30 | 11.1 |

The method of calculation of the horsepower delivered to the gas from the suction tank is as follows:

1. Calculate the absolute gas pressure required to displace the pumping cylinder at each depth.
2. Beginning with suction tank conditions, read the enthalpies of air for each pressure for isothermal compression from a standard air thermodynamic chart.
3. Calculate the mass of air required to displace 100 gallons of volume from the cylinder at the pressure calculated in (1) above and 60° F., not at adiabatic compression temperature.
4. Calculate the difference in gas enthalpy from suction tank condition to the enthalpies for each depth read in (2) above.
5. The calculated horsepower is the mass of air required multiplied by the difference in enthalpy calculated in (4) above converted from BTU/min to horsepower.

The power consumed by the fluid cycle control unit is calculated as the integrated difference in enthalpy of the gas required to displace the volume of fluid displaced from the lower chamber to the upper chamber. As an example for pumping from the cylinder shown above:

| | |
|---|---|
| Volume of sealing fluid displaced | 0.6 gals (0.08 $ft^3$) |
| Volume of pumping cylinder to 30' | 10 gals |
| Discharges required for 100 GPM | 10/min |
| Total cubic feet of fluid/min | 0.8 cubic feet |
| Calculated HP consumed | 0.104 horsepower |

The actual power requirement of any pump would not be defined in these numbers and would be dependent on the compressor design, the depth, diameter, and length of pumping cylinder and pressure losses in the upper check valve and piping. However it is established that:

1. The fraction of power actually delivered to the fluid being pumped varies with the pumping depth, being higher for the first 10 feet of the cylinder in the example case than for the conditions at 30 feet down in the cylinder. These calculations together with the discussion on the fluid cycle control unit established that the pumping efficiency can actually increase somewhat as the compressed gas supply is reduced from maximum.

a. The fluid cycle control unit 3, adjusted for maximum gas flow automatically lengthens the displacement time and shortens the pumping depth automatically and without attendance or adjustment on reduction of the compressed gas flow supplied to the pumping cylinder.

b. The efficiency can and will improve both because of the shorter cylinder displacement and because displacement stage time is extended with respect to the equalization stage.

The power loss during the venting stage can be minimized by design of the compressor and motor. Use of an inertia wheel should be considered for large drivers.

In cases where it is desired to pump from depths greater than 40 feet it is possible and recommended to operate two pumping cylinders in series from a single compressor. The use of two pumping cylinders is accomplished by placing two upper check valve 10 and center tubes 14 in a single pumping cylinder 11. Two cycle control units 3 are utilized, one for each pumping cylinder. The outlet of the cycle control unit on the lower cylinder is connected to supply compressed gas to the upper cylinder and to the inlet of the cycle control unit on the upper cylinder. The outlet of the cycle control unit on the upper cylinder is connected to the compressor suction bottle. The compressed gas flow is from the compressor to the lower pumping cylinder to the primary cycle control unit to the upper cylinder through the second cycle control unit to the compressor 4 suction bottle.

A figure for the two units in series is not presented as sufficient detail has been presented for the pumping unit and control unit to allow design and assembly of the stacked unit without difficulty.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. A well pumping system for a well extending from the surface into the earth having therein a tubing string, comprising;

a pumping chamber for positioning adjacent a lower end of the tubing string including a lower check valve allowing liquid entry into the chamber, a dip tube extending into the pumping chamber providing communication between the pumping chamber and the tubing string, and an upper check valve allowing upward flow through the dip tube into the tubing string;

a gas conduit extending into the pumping chamber adjacent the upper end thereof; and means providing a closed gas cycle for delivering pressurized gas down the gas conduit to discharge liquid in the pumping chamber through the dip tube and upper check valve into the tubing string and then receiving gas flowing upwardly in the gas conduit from the chamber to depressurize the chamber comprising a suction tank having an inlet and an outlet, a gas compressor having an inlet connected to the suction tank outlet and an outlet connected to the gas conduit, and a control unit having an inlet connected to the gas compressor outlet in parallel with the gas conduit for simultaneously receiving pressurized gas from the compressor outlet and an outlet connected to the suction tank inlet, the control unit comprising means including a continuously open flow restrictor for diverting pressurized gas into the gas conduit for a predetermined interval and, after the predetermined interval, for allowing passage of pressurized gas from the gas compressor outlet to the suction tank inlet.

2. The well pumping system of claim 1 wherein the dip tube extends into the pumping chamber a predetermined distance and the gas conduit opens into the pumping chamber above a lower end of the dip tube.

3. The well pumping system of claim 1 wherein the control unit includes a liquid filled compartment providing the control unit inlet and including a compartment outlet having therein the continuously open restrictor and means for refilling the compartment with liquid after emptying in response to the passage of gas therethrough from the compressor outlet.

4. The well pumping system of claim 1 wherein the flow restrictor comprises means for restricting gas flow from the compressor outlet to the storage tank inlet for a predetermined time to divert at least a majority of the pressurized gas to the gas conduit and means operable after the predetermined time for allowing unrestricted gas flow from the compressor outlet to the storage tank inlet to allow gas flow upwardly from the pumping chamber.

5. The well pumping system of claim 4 further comprising means for adjusting the gas flow restricting means for modifying the predetermined time.

6. The well pumping system of claim 4 wherein the control unit comprises an upper compartment in communication with the suction tank inlet, a lower compartment in communication with the compressor outlet, first and second conduits communicating between the upper and lower compartments, a quantity of liquid in the compartments sufficient to fill the lower compartment and partially to fill the upper compartment, means allowing liquid movement through the first conduit, and means preventing upward liquid movement through the second conduit into the upper compartment until a majority of the liquid moves from the lower compartment through the first conduit into the upper compartment and then allowing gas movement through the second conduit, whereby the flow of pressurized gas from the compressor outlet through said control unit to the suction tank is prevented thus diverting at least a majority of the pressurized gas to the pumping chamber while the remainder of the pressurized gas enters the lower compartment to pressurize the liquid therein and force the same upwardly through the first conduit into the upper compartment until sufficient liquid has been displaced from the lower compartment to actuate the preventing means at which time there is unrestricted flow of pressurized gas from the compressor outlet, into the lower compartment, through the second conduct and upper compartment to the suction tank, thus depressurizing the pumping chamber.

7. The well pumping system of claim 6 wherein the means preventing upward liquid movement comprises a valve seat in the second conduit and a float valve in the second conduit buoyant in the liquid for sealing against the valve seat until a majority of the liquid is exhausted from the lower compartment.

8. The well pumping system of claim 7 wherein the second conduit comprises a lower end open to liquid in the lower compartment and a bypass opening intermediate the valve seat and the lower end whereby downward movement of the float valve allows gas movement from the lower compartment, through the bypass opening and second conduit into the upper compartment.

9. The well pumping system of claim 8 comprising means for adjusting flow through the first conduit for modifying the time required to exhaust liquid from the lower compartment.

10. The well pumping system of claim 9 wherein the flow adjusting means comprises an adjustable nozzle having a stationary component and an adjustable component, and an operator and connected to the adjustable component for moving the adjustable component.

11. The well pumping system of claim 6 including means allowing gravitational liquid flow from the upper compartment to the lower compartment after allowing gas movement through the second conduit.

12. The well pumping system of claim 11 wherein the means allowing gravitational liquid flow comprises a check valve exposed to hydrostatic pressure in the upper and lower compartments for allowing liquid flow from the upper compartment to the lower compartment in response to higher hydrostatic pressure from the upper compartment than from the lower compartment.

13. The well pumping system of claim 6 wherein the suction tank comprises a pressure vessel having an oil compartment therein and means for delivering oil from the compartment to the compressor.

14. The well pumping system of claim 13 wherein the oil delivering means comprises a third conduit providing an axial passage in communication with the compressor inlet and a first radial passage;

a fourth conduit surrounding the third conduit and providing a second radial passage below the first radial passage in communication with the oil compartment;

the third and fourth conduits providing therebetween an annular passage;

means sealing between the third and fourth conduits above the first radial passage; and means sealing between the third and fourth conduits below the second radial passage.

15. A well pumping system for a well extending from the surface into the earth having therein a tubing string, comprising;

a pumping chamber for positioning adjacent a lower end of the tubing string including a lower check valve allowing liquid entry into the chamber, a dip tube extending into the pumping chamber providing communication between the pumping chamber and the tubing string, and an upper check valve allowing upward flow through the dip tube into the tubing string;

a gas conduit extending into the pumping chamber adjacent the upper end thereof; and means providing a closed gas cycle for delivering pressurized gas down the gas conduit to discharge liquid in the pumping chamber through the dip tube and upper check valve into the tubing string and then receiving gas flowing upwardly in the gas conduit from the chamber to depressurize the chamber comprising a suction tank having an inlet and an outlet;

a gas compressor having an inlet connected to the suction tank outlet and an outlet connected to the gas conduit; and a control unit having an inlet connected to the gas compressor outlet in parallel with the gas conduit for simultaneously receiving pressurized gas therewith and an outlet connected to the suction tank inlet, the control unit comprising means for diverting pressurized gas into the gas conduit for a predetermined interval and, after the predetermined interval, for allowing passage of pressurized gas from the gas compressor outlet to the suction tank.

16. A well pumping system for a well extending from the surface into the earth having therein a tubing string, comprising a pumping chamber for positioning adjacent a lower end of the tubing string; a gas conduit extending into the pumping chamber; means providing a closed gas cycle for delivering pressurized gas down the gas conduit to discharge liquid in the pumping chamber through the tubing string and then receiving gas flowing upwardly in the gas conduit from the chamber to depressurize the chamber comprising a suction tank having an inlet and an outlet;

a gas compressor having an inlet connected to the suction tank outlet and an outlet connected to the gas conduit; and a control unit having an inlet connected to the gas compressor outlet in parallel with the gas conduit for simultaneously receiving pressurized gas therewith and an outlet connected to the suction tank inlet, the control unit comprising means including a continuously open flow restrictor to pressurized gas from the gas compressor outlet for diverting pressurized gas into the gas conduit for a predetermined interval and, after the predetermined interval, for allowing passage of pressurized gas from the gas compressor outlet to the suction tank.

* * * * *